United States Patent [19]

Dideriksen

[11] Patent Number: 5,015,210

[45] Date of Patent: May 14, 1991

[54] TOY WASH

[75] Inventor: Erling T. Dideriksen, Billund, Denmark

[73] Assignee: Interlego A.G., Baar, Switzerland

[21] Appl. No.: 476,371

[22] PCT Filed: Dec. 1, 1988

[86] PCT No.: PCT/DK88/00199

§ 371 Date: May 22, 1990

§ 102(e) Date: May 22, 1990

[87] PCT Pub. No.: WO89/05180

PCT Pub. Date: Jun. 15, 1989

[30] Foreign Application Priority Data

Dec. 2, 1987 [DK] Denmark ..... 6323/87

[51] Int. Cl.[5] ..... A63H 33/00

[52] U.S. Cl. ..... 446/128; 446/236; 446/423

[58] Field of Search ..... 446/118, 128, 236, 423, 446/476

[56] References Cited

U.S. PATENT DOCUMENTS

| | | | |
|---|---|---|---|
| 2,776,522 | 1/1957 | Schramm et al. | 446/423 |
| 3,751,847 | 8/1973 | Neuhierl | 446/429 |
| 4,270,303 | 6/1981 | Xanthopoulos | 446/128 |
| 4,356,657 | 11/1982 | Goldfarb | 446/226 |

FOREIGN PATENT DOCUMENTS

| | | | |
|---|---|---|---|
| 1074461 | 1/1960 | Fed. Rep. of Germany . | |
| 3215214 | 11/1983 | Fed. Rep. of Germany . | |
| 2064739 | 6/1971 | France . | |
| 2092463 | 8/1982 | United Kingdom | 446/423 |

*Primary Examiner*—Richard J. Johnson

*Attorney, Agent, or Firm*—Kane, Dalsimer, Sullivan, Kurucz, Levy, Eisele and Richard

[57] ABSTRACT

A toy wash, which is preferably built by means of elements from a toy building set, comprises, in a preferred embodiment, two brush assemblies (6,7) comprising a cylindrical brush which is rotatably journalled in a bracket (9) which is journalled pivotably about a vertical axis. An elastic connector (15,16) is connected between respective brackets and a pair of carrier beams (3,4), thus providing at the same time biasing of the brush assemblies with a spring force which acts on the assemblies in a direction toward a front beam (5), and the connectors (15, 16) are also so constructed that they resemble the hose and cable connections which are present in a real life wash between its frame and brushes.

2 Claims, 1 Drawing Sheet

TOY WASH

The invention concerns a toy wash comprising a frame and cylindrical wash brushes which are journalled in at least one pivotable arm which protrudes transversely to the shaft of the brush and is pivotably connected with the frame. Such a toy is known in principle from the British Patent Application 2,092,463, but this known toy is very complicated and expensive.

The object of the invention is to provide a toy wash which is very simple and also has a great play effect. In particular, the toy wash can be built by means of components belonging to a building set so that there are many possible combinations where simplicity as well as resemblance to real life can be achieved.

This object is achieved in that the toy wash is constructed so that elastic connector serves both as a spring and to resemble the hoses and cables which are present between the brushes and the frame in real life.

Such a wash can be built by means of very simple components belonging to a building set. The connector end coupled to the frame can be moved about on the various coupling means of the frame, thus changing the spring effect and the visual impression.

Figure 1:
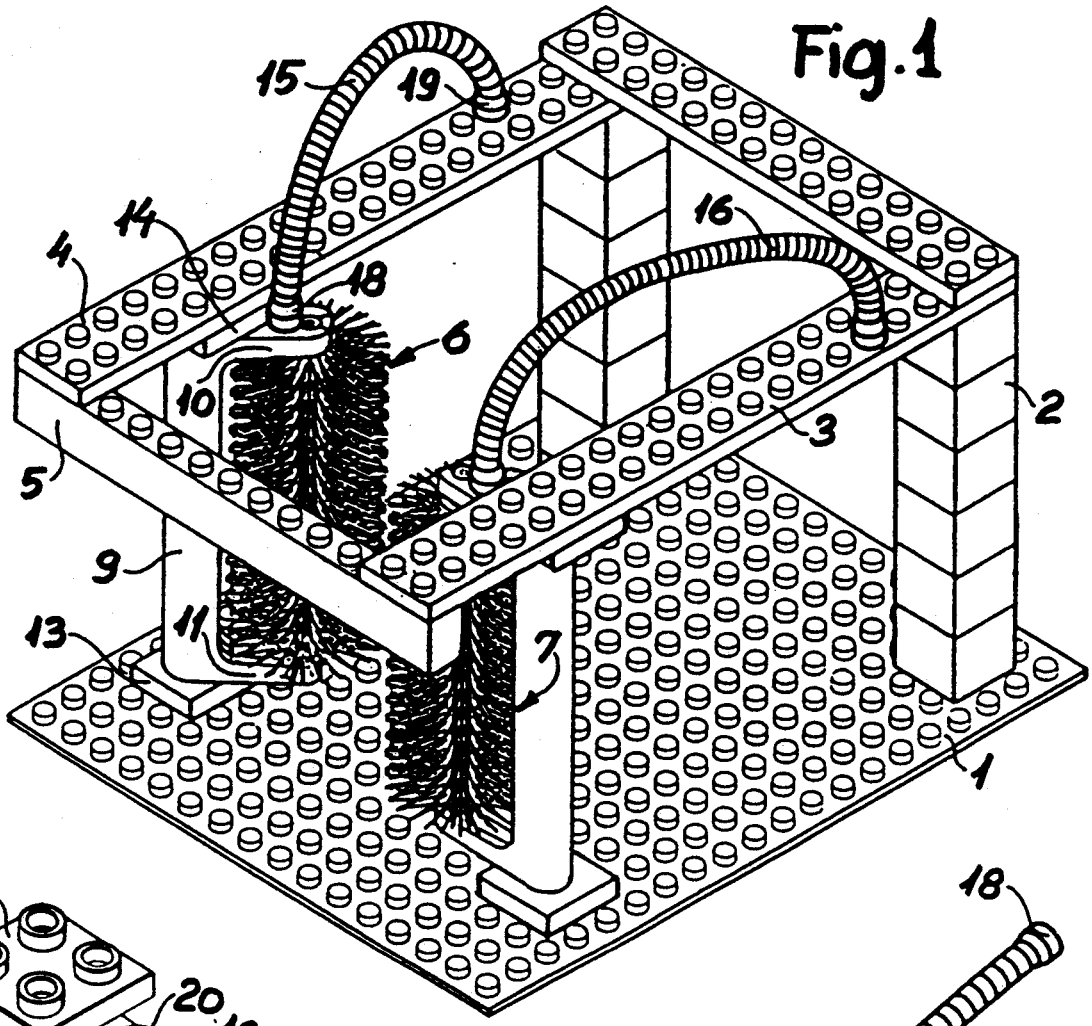
Figure 2:
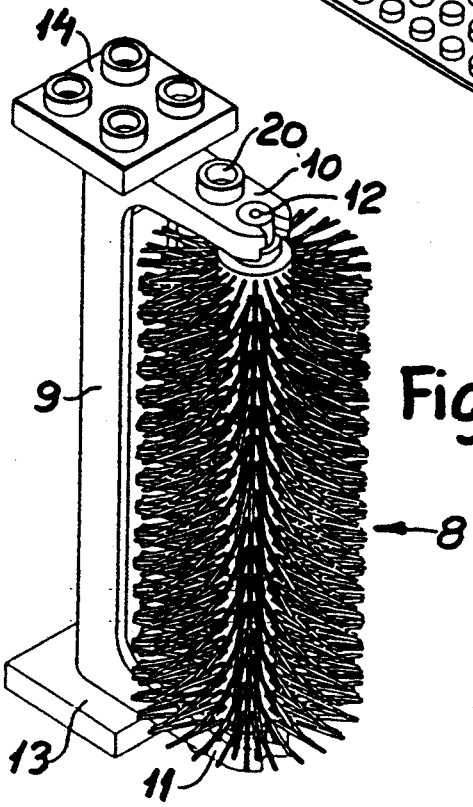
Figure 3:
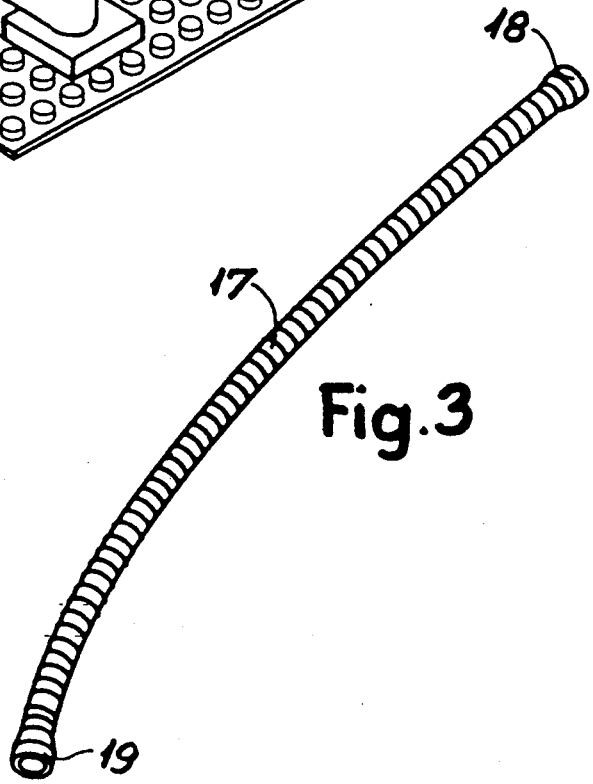

The invention will be explained more fully by the following description of an embodiment with reference to the drawing, in which FIG. 1 is a perspective view of an embodiment of the wash, FIG. 2 shows a brush element associated with the wash of FIG. 1, while FIG. 3 shows a connector for the wash shown in FIG. 1.

The embodiment of the toy wash of the invention shown in FIG. 1 is built by means of a building set of a well-known type. The building set comprises i.a. a base plate 1, box-shaped building blocks Z, flat connecting beams 3, 4, a high connecting beam 5 as well as a pair of wash brush elements 6, 7 of the type shown in FIG. 2. As appears from the drawing, the building elements are provided with a plurality of coupling studs and have recesses on the underside for cooperation with the coupling studs, so that various toy models can be built by means of the building set.

The brush element in FIG. 2 comprises a cylindrical brush 8 and a bracket 9 with a pair of transverse arms

10, 11 which are adapted to receive the shaft 12 of the brush. The bracket 9 is rotatably journalled in a lower and an upper connecting plate 13, 14, the connecting plate 14 of which has four coupling studs on the upper side and the connecting plate 13 is formed on its underside with cavities to receive such coupling studs. The brush assembly can hereby easily be incorporated, as shown in the model of FIG. 1.

As appears from FIG. 1, a respective connector 15, 16 is present between the transverse arms 10 and the frame formed by the building elements. The connectors are oblong and elastic and are mounted with such an arc shape that they bias the respective brush assembly in a direction toward the connecting beam 5. The brush assemblies 6 and 7 are shown in different positions, and it will be appreciated that when s toy car is driven through the wash assembly, the brushes swing elastically aside depending upon the size of the car, and return lo the position of rest when the car is driven out of the wash assembly. The play effect is enhanced additionally in that the arc-shaped connectors give an impression of the hoses and cables which are present in real life wash assemblies.

FIG. 3 shows an example of an oblong, elastic connector 17 which has a coupling means 18 19 st each end. The last-mentioned coupling means are adapted to cooperate with the coupling studs of the toy building set, in particular the coupling stud 20 shown on the arm 10. When the coupling means 19 is moved about on the coupling studs of the connector 4, the arc shape of the connector 15 may be changed, thereby changing both the spring effect and the visual impression.

I claim:

1. A toy wash comprising a frame, at least one arm pivotally connected to said frame, a cylindrical wash brush disposed about a shaft and journalled to said arms, said arm protruding transversely to said shaft and an arch-shaped, elastic connector extending between said frame and said arm to spring bias said arm.

2. The invention in accordance with claim 1 wherein said wash is formed of toy building set components each having complimentary mechanical coupling means and said connector has coupling means at each end thereof, said coupling means being adapted to be releasably coupled to coupling means on the pivotal arm and coupling means of the components of said toy building set.

* * * * *